US006733378B1

(12) United States Patent
Tank et al.

(10) Patent No.: US 6,733,378 B1
(45) Date of Patent: May 11, 2004

(54) ABRASIVE BODY

(76) Inventors: Klaus Tank, 9 Warbleton Ave. Essexwold, Bedfordview, 2007 (ZA); Roy Derrick Achilles, 608 San Martinho, Leiester Road, Bedfordview, 2007 (ZA)

( * ) Notice: Subject to any disclaimer, the term of this patent is extended or adjusted under 35 U.S.C. 154(b) by 0 days.

(21) Appl. No.: 09/743,277

(22) PCT Filed: Jul. 1, 1999

(86) PCT No.: PCT/IB99/01230

§ 371 (c)(1),
(2), (4) Date: Feb. 1, 2001

(87) PCT Pub. No.: WO00/01917

PCT Pub. Date: Jan. 13, 2000

(30) Foreign Application Priority Data

Jul. 6, 1998 (ZA) ..... 98/5923

(51) Int. Cl.[7] ..... B23F 21/03

(52) U.S. Cl. ..... 451/540; 451/530; 451/539; 451/548; 175/428

(58) Field of Search ..... 451/530, 539, 451/548, 540, 541; 175/428

(56) References Cited

U.S. PATENT DOCUMENTS

| | | | | |
|---|---|---|---|---|
| 5,472,376 A | | 12/1995 | Olmstead et al. | 451/540 |
| 5,645,617 A | * | 7/1997 | Frushour | 51/309 |

FOREIGN PATENT DOCUMENTS

| | | | | |
|---|---|---|---|---|
| EP | 0 356 097 | | 2/1990 | |
| EP | 0 659 510 | | 6/1995 | |
| EP | 0 692 607 | | 1/1996 | |
| EP | 0 692607 | * | 3/1996 | 10/56 |

* cited by examiner

*Primary Examiner*—Joseph J. Hail, III
*Assistant Examiner*—Alvin J Grant
(74) *Attorney, Agent, or Firm*—Oblon, Spivak, McClelland, Maier & Neustadt, P.C.

(57) ABSTRACT

An abrasive body which includes an abrasive layer bonded to a substrate along an interface and at least one strip-like projection extending from the interface into the substrate. The projection has a profile which includes a substantially flat central portion and connecting surfaces to either side of the central section. The surface is sloped from the central section to the interface.

11 Claims, 3 Drawing Sheets

ABRASIVE BODY

BACKGROUND OF THE INVENTION

This invention relates to an abrasive body and more particularly to an abrasive body which can be used as a tool insert.

Composite abrasive compacts are products used extensively as inserts for abrasive tools such as drill bits. Such composite abrasive compacts comprise an abrasive compact layer bonded to a cemented carbide support. The abrasive compact will typically be a diamond abrasive compact, also known as polycrystalline diamond or PCD, or a cubic boron nitride compact, also known as polycrystalline CBN or PCBN.

Composite abrasive compacts are manufactured under elevated temperature and pressure conditions. e.g. diamond or cubic boron nitride synthesis conditions.

As it is known that PCD composite compacts contain considerable residual stresses as a result of the high temperature/high pressure conditions used in their manufacture. Further, methods of mounting such compacts into drill bits, for example press fitting or brazing, can modify the stress distributions in the compacts. Additional stresses are imposed on the compacts during their use in applications such as drilling. Stresses may be introduced into the interface between the abrasive compact layer and the cemented carbide support. These stresses may be reduced or modified by providing a recess which extends into the cemented carbide support from the compact/carbide interface and which is filled with the abrasive compact. In the prior art, the recess has taken various shapes such as a plurality of concentric rings, a V-shaped recess, a cross-shaped recess, and a recess which incorporates a number of steps. A purpose in most of such designs is to reinforce and support the cutting edge by providing overall rigidity for the composite compacts.

U.S. Pat. No. 5,472,376 describes a tool component comprising an abrasive compact layer bonded to a cemented carbide substrate along an interface. A recess extends from the interface into the substrate and is filled with abrasive compact. The recess has a stepped configuration and is located entirely within the carbide substrate.

EP 356097 describes a tool insert comprising an abrasive compact bonded to a cemented carbide substrate. The abrasive compact is located in a recess formed in the substrate. The abrasive compact has a top surface which provides a cutting edge for the tool insert, a bottom surface complimentary to the base of the recess and a side surface at least partially located in the recess, the portion of the side surface located in the recess being complimentary to the side of the recess. The side surfaces may be sloping.

SUMMARY OF THE INVENTION

According to the present invention, an abrasive body, for use, for example, as a tool insert, comprises an abrasive layer bonded to a substrate along an interface and at least one strip-like abrasive projection extending from the interface into the substrate, the projection having a profile which includes a substantially flat central portion and surfaces to either side thereof which slope towards the interface.

More than one strip-like projection may be provided. Such projection or projections may extend from one peripheral surface of the abrasive body to an opposite peripheral surface. The projection or projections preferably have a surface coincident with a peripheral surface of the body.

In another form of the invention, three parallel strip-like projections are provided, the inner projection having a width greater than that of the outer projections.

In yet another form of the invention, the strip-like projection has an essentially U-form in plan. Preferably, the limbs of the U have ends coincident with an outer surface of the body.

DESCRIPTION OF EMBODIMENTS

Figure 1:
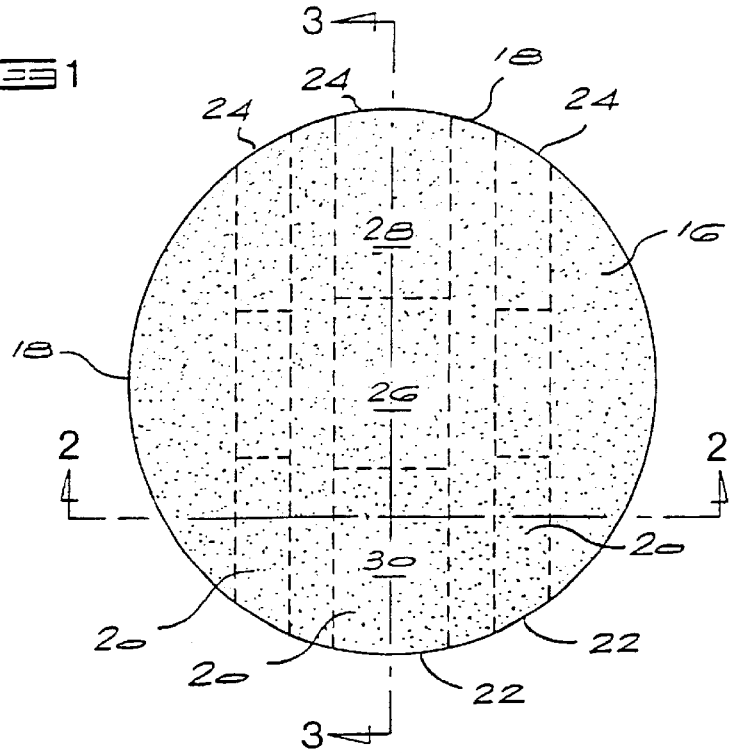
FIG. 1 is a plan view of a first embodiment of the invention.

The abrasive body may have various shapes, but is preferably right circular cylindrical.

The substrate layer will typically be a cemented carbide substrate layer. The cemented carbide of the substrate may be any known in the art such as cemented titanium carbide, cemented tungsten carbide, cemented tantalum carbide, cemented molybdenum carbide, or mixtures thereof. As is known, such cemented carbides will typically have a binder content of 3 to 30% by mass. The metal binder will typically be cobalt, iron or nickel or an alloy containing one or more of these metals.

The abrasive layer will generally be an abrasive compact layer or a layer of diamond produced by chemical vapour deposition (CVD). When the abrasive layer is an abrasive compact layer, it will preferably be a diamond compact layer or a cubic boron nitride compact layer.

A first embodiment of the invention will now be described with reference to FIGS. 1 to 3. Referring to these figures, there is shown an abrasive body comprising an abrasive compact layer 10 bonded to a substrate 12, generally a cemented carbide substrate, along an interface 14 (see FIG. 2). The top surface 16 of the layer 10 provides an abrasive surface for the body and the peripheral edge 18 provides a cutting edge, remote from the interface. The interface 14 has portions 14*a* and 14*b* which slope relative to the surface 16 and central portions 14*c* and 14*d* which are parallel to this surface. All these portions of the interface 14 may, in an alternative embodiment, be parallel to the surface 16.

The abrasive body is characterised, in particular, by the provision of three strip-like projections 20 of abrasive compact which extend from the interface 14 into the substrate 12. These projections 20 extend from one peripheral side surface of the abrasive body to an opposite peripheral side surface. Thus, each projection has a surface identified as 22 and 24 coincident with a peripheral side surface of the abrasive body.

Figure 3:
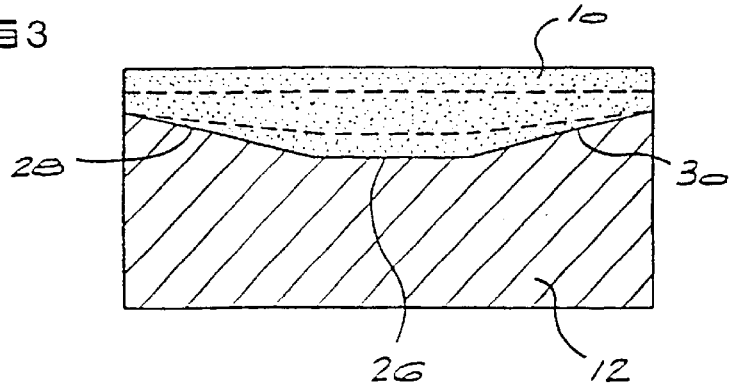
FIG. 3 is a section along the line 3—3 of FIG. 1.

The profile i.e. the longitudinal cross-sectional shape, of the strips is best illustrated by FIG. 3. Referring to this figure, it will not noted that the profile is such that there is a central flat section identified as 26 and surfaces 28, 30 to either side of the central section. The surfaces 28, 30 slope from the central section 26 to the interface 14.

Figure 2:
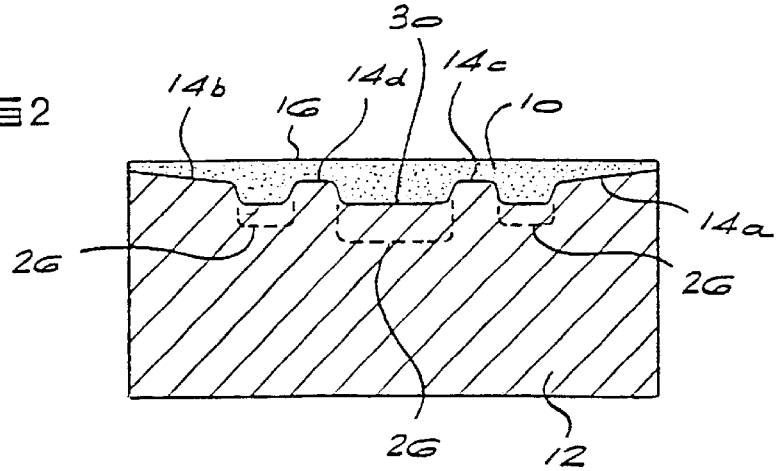
FIG. 2 is a section along the line 2—2 of FIG. 1.

It will be noted from FIGS. 1 and 2 that the width in plan of the central strip-like projection is greater than that of the outer strip-like projections. This is a preferred configuration. Other configurations, e.g. in which the widths are the same, are possible.

Figure 4:
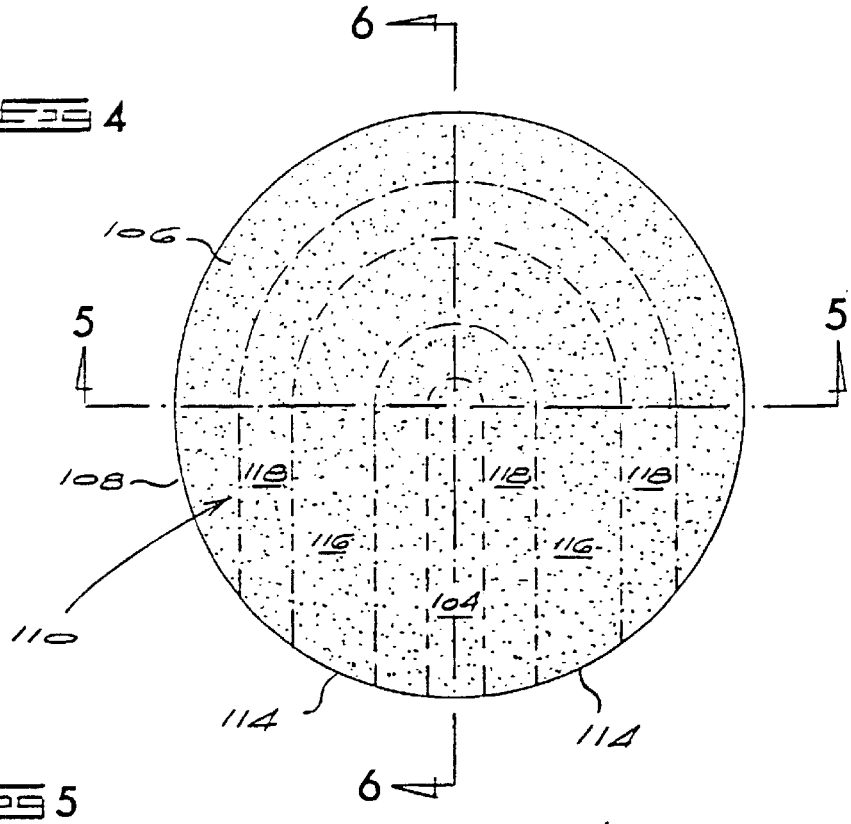
FIG. 4 is a plan view of a further embodiment of the invention.

A second embodiment of the invention will now be described with reference to FIGS. 4 to 6. Referring to these figures, an abrasive body comprises an abrasive compact 100 bonded to a substrate 102, particularly a cemented carbide substrate, along an interface 104. The surface 106 of the abrasive compact layer 100 provides an abrasive surface for the body, while the peripheral edge 108 provides a cutting edge, remote from the interface.

An abrasive compact projection 110 extends from the interface 104 into the substrate 102. This projection has an essentially U-shape in plan, as can be seen from FIG. 5. The limbs of the U extend to the outer surface 112 of the abrasive body. Thus, the limbs have edge surfaces 114 coincident with the outer surface 112 of the body.

Figure 5:
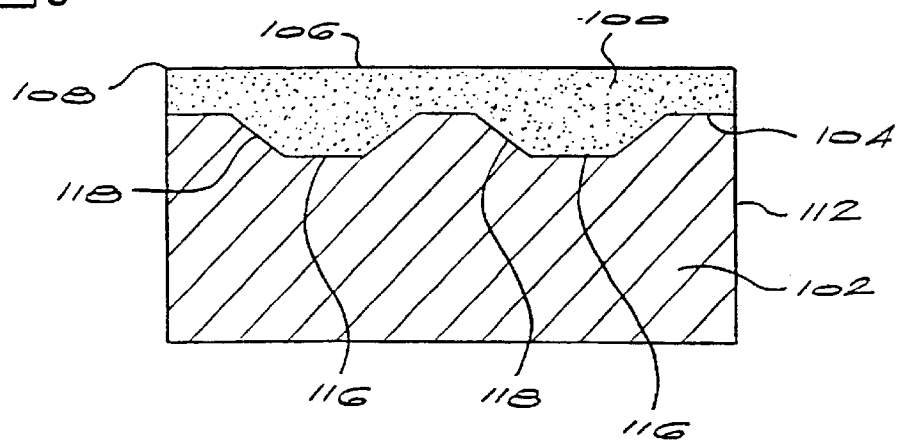
FIG. 5 is a section along the line 5—5 of FIG. 4.
Figure 6:
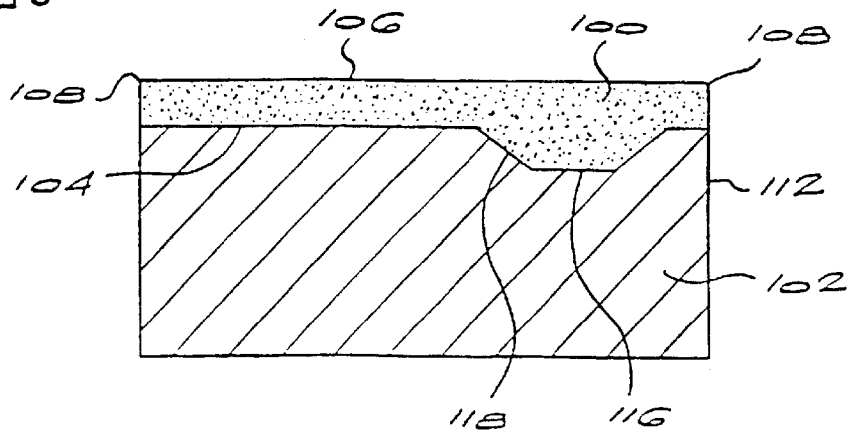
FIG. 6 is a section along the line 6—6 of FIG. 4.

The profile of the projection 110 is illustrated from different directions by FIGS. 5 and 6. It will be noted from these figures that the profile is such that there is a central flat section 116 and surfaces 118 which slope from the central section 116 to the interface 104.

Figure 7:
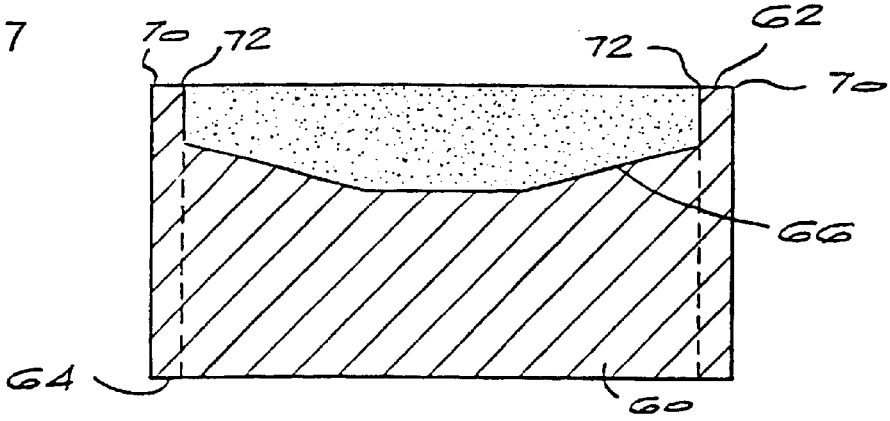
FIG. 7 is a sectional side view of a further embodiment of the invention.

The abrasive bodies described above may be made by methods known in the art. Generally this will involve providing a cylindrical shaped cemented carbide body having a recess, to receive the components necessary to make an abrasive compact, formed in one end thereof. An example of such a body, to produce an abrasive body of FIGS. 1 to 3, is shown in FIG. 7. Referring to this figure, a cemented carbide body 60 is of right-circular cylindrical shape having flat ends 62 and 64. A recess 66 is provided in the end 62. This recess is filled with the components necessary to make an abrasive compact. The thus produced unbonded assembly is placed in the reaction zone of a conventional high temperature/high pressure apparatus to form an abrasive compact of the components which bonds to the body 60. The abrasive body illustrated by FIGS. 1 to 3 is produced by simply removing the sides of the body 60, as illustrated by the dotted lines. However, the bonded body which is recovered from the reaction zone after compact formation and without removal of the carbide sides, may be used as a tool insert itself, and forms another aspect of the invention. In this form of the insert, the edge 70 will provide the cutting edge. This edge is likely to wear away fairly rapidly until the abrasive compact edge 72 is reached. Thereafter it is this edge 72 which provides the cutting edge for the component.

The provision of the strip-like projections in the abrasive bodies of the invention result in an effective reinforcement and support for the cutting edge by providing overall rigidity for the bodies. Further, in use the cutting edges in the regions of the surfaces 22, 24 of the projection for the FIGS. 1 to 3 embodiment and in the region of the surfaces 114 of the projection for the FIGS. 4 to 6 embodiment will be employed. The extra abrasive available in these regions increases effectiveness of the abrasive action of the body.

What is claimed is:

1. An abrasive body comprises an abrasive layer bonded to a substrate along an interface and at least three parallel strip-like projections extending from the interface into the substrate, the projections each having a profile which includes a substantially flat central portion and connecting surfaces which join the flat central portion to the interface and slope towards the interface, wherein an inner projection is provided with a width greater than that of outer projections.

2. An abrasive body according to claim 1 wherein the strip-like projections extend from one peripheral surface of the abrasive body to an opposite peripheral surface.

3. An abrasive body according to claim 1 wherein the projections have a surface coincident with a peripheral surface of the body.

4. An abrasive body according to claim 1 wherein the abrasive layer is selected from an abrasive compact and a layer of diamond produced by chemical vapour deposition.

5. An abrasive body according to claim 1 wherein the substrate is a cemented carbide substrate.

6. An abrasive body according to claim 1 which has a right-circular cylindrical shape.

7. An abrasive body according to claim 1, wherein the abrasive layer has a cutting edge, and wherein the projections are oriented substantially perpendicular to the cutting edge.

8. An abrasive body comprises an abrasive layer bonded to a substrate along an interface and a plurality of strip-like projections extending from the interface into the substrate, the abrasive layer having a planar top surface, the projections each having a profile which includes a substantially flat central portion and connecting surfaces which join the flat central portion to the interface and slope from the central portion towards the top surface, wherein the strip-like projections are substantially U-shaped in plan view.

9. An abrasive body according to claim 8 wherein limbs of the U have ends coincident with an outer surface of the body.

10. An abrasive body comprises an abrasive layer bonded to a substrate along an interface and at least one strip-like projection extending from the interface into the substrate, the abrasive layer having a planar top surface, the projection having a widthwise profile which includes a substantially flat central portion and first connecting surfaces which join the central portion to the interface and extend from the central portion towards the top surface, and the projection having a lengthwise profile which includes the substantially flat central portion and second connecting surfaces which join the central portion to the interface and incline from the central portion towards the top surface.

11. A method of using an abrasive body including an abrasive layer bonded to a substrate along an interface and at least one strip-like projection extending from the interface into the substrate, the projection having a profile which includes a substantially flat central portion and connecting surfaces which join the flat central portion to the interface and slope towards the interface, the abrasive layer having a cutting edge wherein the at least one strip-like projection is oriented substantially perpendicular to the cutting edge, the method comprising the step of:

mounting the abrasive body as an insert for an abrasive tool wherein the cutting edge is oriented to cut an object being worked on by the abrasive tool.

* * * * *